US011621501B2

(12) United States Patent
Yaoita et al.

(10) Patent No.: US 11,621,501 B2
(45) Date of Patent: Apr. 4, 2023

(54) TERMINAL, WIRE HARNESS, AND ELECTRIC WIRE WITH TERMINAL

(71) Applicant: Yazaki Corporation, Tokyo (JP)

(72) Inventors: Syunsuke Yaoita, Makinohara (JP); Makoto Koshiishi, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/486,410

(22) Filed: Sep. 27, 2021

(65) Prior Publication Data

US 2022/0102875 A1 Mar. 31, 2022

(30) Foreign Application Priority Data

Sep. 28, 2020 (JP) ..... JP2020-162254
Jul. 19, 2021 (JP) ..... JP2021-118779

(51) Int. Cl.
*H01R 4/18* (2006.01)
*H01B 7/00* (2006.01)
*H01R 43/02* (2006.01)

(52) U.S. Cl.
CPC ..... *H01R 4/185* (2013.01); *H01B 7/0045* (2013.01); *H01R 43/0207* (2013.01)

(58) Field of Classification Search
CPC ..... H01R 4/185; H01B 7/0045
USPC ..... 439/752
See application file for complete search history.

(56) References Cited

U.S. PATENT DOCUMENTS 5,427,553 A * 6/1995 Tsuji ..... H01R 13/187 439/842
5,433,629 A * 7/1995 Yagi ..... H01R 13/187 439/845
5,536,904 A * 7/1996 Kojima ..... H01B 13/322 174/76
5,593,328 A * 1/1997 Okada ..... H01R 13/11 439/843
7,311,561 B2 * 12/2007 Anbo ..... H01R 4/185 439/752.5
7,553,203 B2 * 6/2009 Anbo ..... H01R 13/11 439/852
8,921,696 B2 * 12/2014 Otsuka ..... H01R 43/0207 174/94 R (Continued)

FOREIGN PATENT DOCUMENTS

DE 102019210341 A1 * 1/2020 ..... H01R 4/023
EP 0673082 A1 * 5/2000 ..... H01R 13/187

(Continued)

*Primary Examiner* — Peter G Leigh
(74) *Attorney, Agent, or Firm* — Sughrue Mion, PLLC

(57) ABSTRACT

A terminal includes: a tubular box portion to receive a mating terminal; a spring portion extending in a beam shape from a front end portion of the box portion; and a pressing piece configured to restrict a bending range of the spring portion. A free end of the spring portion is inside the box portion, and the spring portion has a contact point with the mating terminal. The pressing piece is placed at a pressing position located inside the box portion and away from the contact point in the bending direction. The pressing piece is configured to restrict the bending range of the spring portion to achieve at least part of the spring portion closer to the free end than the contact point is located on the bending direction side with respect to the pressing position.

7 Claims, 10 Drawing Sheets

(56) References Cited

U.S. PATENT DOCUMENTS

| | | | | |
|---|---|---|---|---|
| 8,974,256 | B2 * | 3/2015 | Okano | H01R 13/11 439/852 |
| 10,069,232 | B2 * | 9/2018 | Endo | H01R 13/111 |
| 2007/0270050 | A1 | 11/2007 | Anbo et al. | |
| 2011/0062218 | A1 * | 3/2011 | Ohnuma | B23K 20/106 228/110.1 |
| 2013/0000949 | A1 * | 1/2013 | Torimoto | B23K 20/10 228/110.1 |
| 2013/0288547 | A1 * | 10/2013 | Amano | H01R 13/11 439/852 |
| 2019/0165489 | A1 * | 5/2019 | Sato | H01R 4/183 |
| 2019/0165491 | A1 * | 5/2019 | Sato | H01R 4/185 |
| 2020/0091670 | A1 * | 3/2020 | Sato | H01R 4/023 |

FOREIGN PATENT DOCUMENTS

| | | | | | |
|---|---|---|---|---|---|
| EP | 1662617 | A1 | * | 5/2006 | H01R 13/11 |
| EP | 2852004 | A1 | * | 3/2015 | H01R 13/11 |
| EP | 3435491 | A1 | * | 1/2019 | H01R 13/113 |
| FR | 2999818 | A1 | * | 6/2014 | H01R 13/187 |
| JP | 2000323217 | A | * | 11/2000 | H01R 13/187 |
| JP | 2010-118360 | A | | 5/2010 | |
| JP | 2013062230 | A | * | 4/2013 | |
| JP | 2014232662 | A | * | 12/2014 | |
| JP | 2019083155 | A | * | 5/2019 | |

* cited by examiner

TERMINAL, WIRE HARNESS, AND ELECTRIC WIRE WITH TERMINAL

CROSS-REFERENCE TO RELATED APPLICATIONS

This application is based on and claims priority under 35 USC 119 from Japanese Patent Application No. 2021-118779 filed on Jul. 19, 2021 and Japanese Patent Application No. 2020-162254 filed on Sep. 28, 2020, and the contents of which are incorporated herein by reference.

TECHNICAL FIELD

The present invention relates to a terminal, a wire harness, and an electric wire with terminal.

BACKGROUND ART

In recent, a terminal (for example, a so-called crimping terminal) to be attached to an end of an electric wire has been proposed. For example, one crimping terminal in the related art includes a tubular box portion into which a mating terminal is inserted, a beam-shaped spring portion provided inside the box portion and having a contact point with the mating terminal, and a fixing portion for crimping and fixing the terminal to an electric wire.

As for details of the above terminal, refer to JP 2010-118360 A.

Meanwhile, in order to electrically connect the electric wire to which the terminal in the related art is attached and another electric wire, there is a case where ultrasonic bonding processing is performed in a state where conductor core wires of both electric wires are brought into close contact with each other, and both conductor core wires are bonded. In this case, the ultrasonic vibration applied to a bonded portion may be transmitted to the terminal via the electric wire to vibrate the terminal. In particular, since the spring portion has a beam shape, vibration in which elastic deformation and elastic recovery are repeated while bending around a fixed end is likely to occur. Depending on a degree of the vibration, excessive bending or the like repeatedly occurs in the spring portion, which may cause deterioration, plastic deformation, or the like of the spring portion. Similarly, for example, when the terminal in the related art and a conductor core wire of an electric wire are bonded to each other by the ultrasonic bonding processing, there is also a possibility that deterioration or the like of the spring portion due to vibration of the spring portion may occur. From the viewpoint of improving the reliability of the electrical connection between the terminal and the mating terminal, it is desirable to reduce such deterioration or the like of the spring portion as much as possible.

SUMMARY OF INVENTION

Aspect of non-limiting embodiments of the present disclosure relates to provide a terminal excellent in durability against vibration or the like applied from the outside, a wire harness using an electric wire to which such a terminal is attached, and an electric wire with terminal to which such a terminal is attached.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided a terminal to be attached to an electric wire, the terminal comprising:

a tubular box portion to receive a mating terminal;

a spring portion extending in a beam shape from a front end portion of the box portion, a free end of the spring portion being inside the box portion with respect to a rear end portion of the box portion, and the spring portion having a contact point with the mating terminal; and a pressing piece configured to restrict a bending range of the spring portion, the spring portion being configured to elastically deform in a bending direction away from the mating terminal upon the mating terminal coming into contact with the contact point, and the pressing piece being placed at a pressing position located inside the box portion and away from the contact point in the bending direction, the pressing piece being configured to restrict the bending range of the spring portion to achieve at least part of the spring portion closer to the free end than the contact point being located on the bending direction side with respect to the pressing position.

According to another aspect of the present disclosure, there is provided a wire harness comprising:

a plurality of electric wires; and the above described terminal attached to at least one of the plurality of electric wires, the wire harness having a bonded portion, conductor core wires of the plurality of electric wires being bonded with each other to form the bonded portion, and the bonded portion having a bonding mark formed by ultrasonic bonding processing.

According to still another aspect of the present disclosure, there is provided an electric wire with terminal comprising:

an electric wire; and the above described terminal according to claim 1 attached to the electric wire, a conductor core wire of the electric wire and the terminal being bonded to each other to form a bonded portion, and the bonded portion having a bonding mark formed by ultrasonic bonding processing.

BRIEF DESCRIPTION OF DRAWINGS

Exemplary embodiment(s) of the present invention will be described in detail based on the following figures, wherein:

FIGS. 1A and 1B show an electric wire with terminal to which a terminal according to an embodiment of the present invention is attached, in which FIG. 1A is a perspective view of the electric wire with terminal, and FIG. 1B is a plan view of the electric wire with terminal;

FIGS. 4A and 4B are a plan view showing a wire harness according to an embodiment of the present invention having a bonded portion at which conductor core wires of a plurality of electric wires with terminal are ultrasonically bonded to each other, in which FIG. 4A shows a state in which the bonded portion is exposed to the outside, and FIG. 4B shows a state in which the bonded portion is covered with a protective member;

DESCRIPTION OF EMBODIMENTS

Figure 1A:
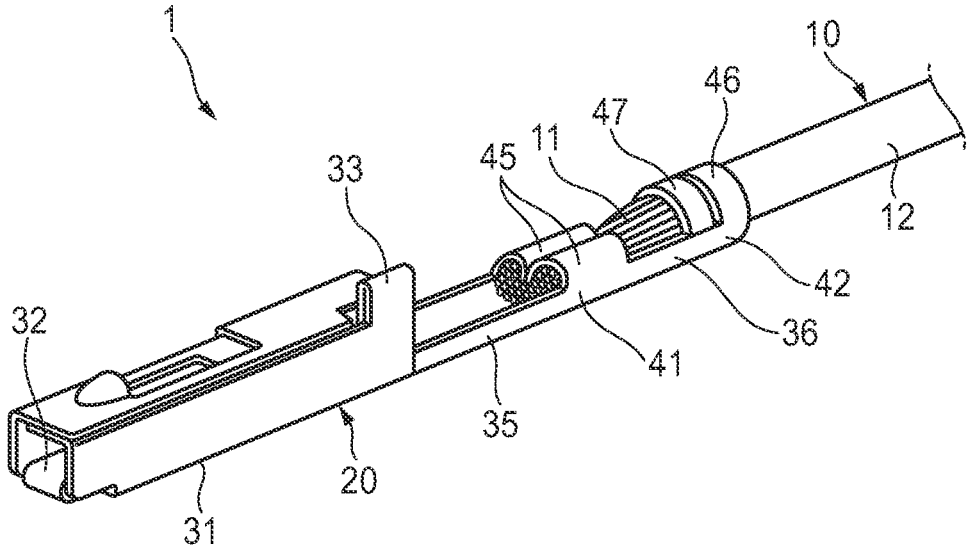

Hereinafter, an electric wire with terminal 1 in which a terminal 20 according to an embodiment of the present invention is attached to an electric wire 10 will be described with reference to the drawings. Hereinafter, for convenience of description, in an axial direction (fitting direction) of the terminal 20, a side (left side in FIGS. 1A, 1B and 2) to which a mating terminal (not shown) is fitted is referred to as a front end side (front side), and an opposite side thereof (right side in FIGS. 1A, 1B and 2) is referred to as a base end side (rear side). An upper side and a lower side in FIGS. 1A and 2 are referred to as an upper side and a lower side, respectively. A direction orthogonal to the axial direction and an upper-lower direction of the terminal 20 is referred to as a width direction.

Figure 1B:
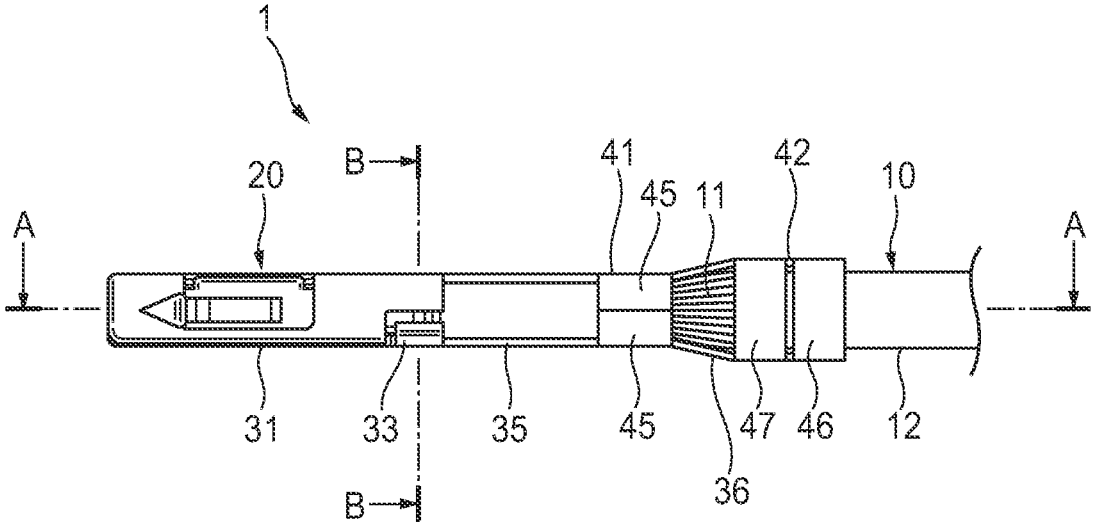
Figure 2:
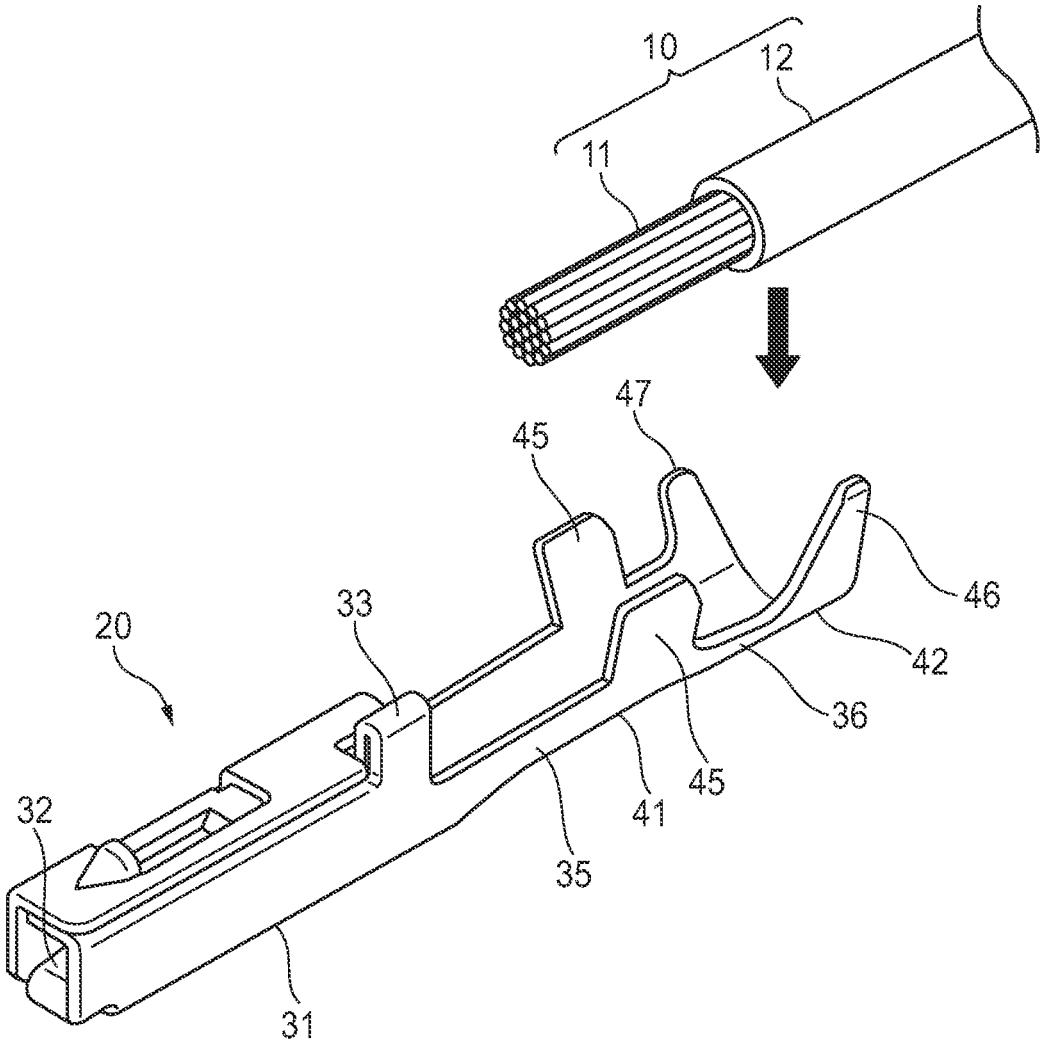
FIG. 2 is a perspective view showing a state before the terminal is crimped to an electric wire.
Figure 3A:
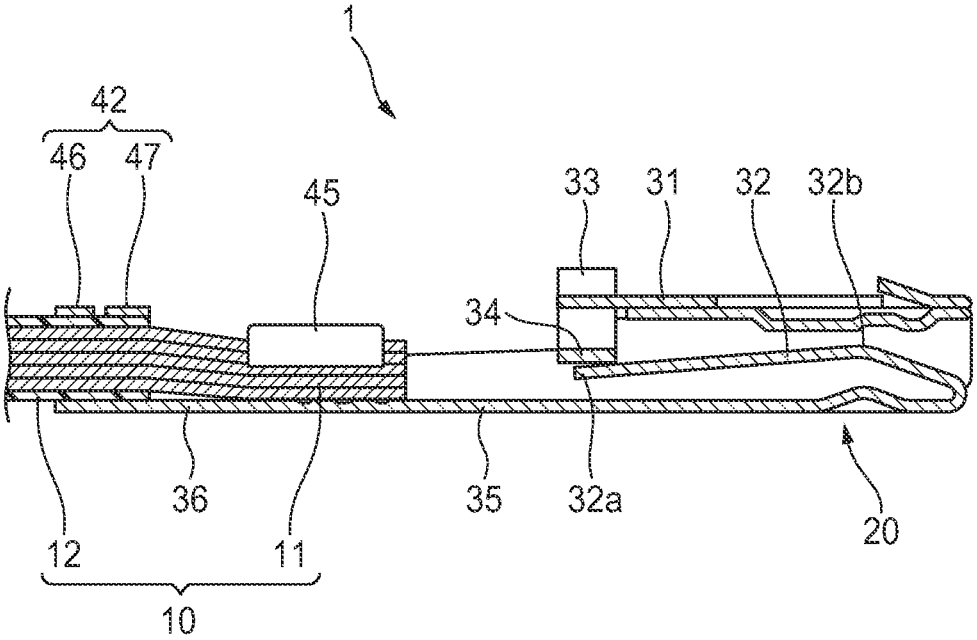
FIG. 3A is a cross-sectional view taken along a line A-A in FIG. 1B.

As shown in FIGS. 1A, 1B and 3A, the terminal 20 is crimped to an end portion of the electric wire 10, and the terminal 20 and a conductor core wire 11 of the electric wire 10 are electrically connected to each other. The electric wire 10 and the terminal 20 constitute the electric wire with terminal 1. The electric wire with terminal 1 constitutes, for example, a wire harness 2 (see FIGS. 4A and 4B) routed in a vehicle such as an automobile.

The electric wire 10 is an insulated electric wire having the conductor core wire 11 and a covering body 12 that is made of a resin and covers the conductor core wire 11. In this example, the conductor core wire 11 is made of aluminum or an aluminum alloy, and is formed by twisting a plurality of strands. Since the conductor core wire 11 of the electric wire 10 is made of aluminum or an aluminum alloy, the electric wire with terminal 1 is reduced in weight, and the wire harness 2 including the electric wire with terminal 1 is also reduced in weight. The electric wire with terminal 1 reduced in weight is particularly suitably used in a vehicle in which a wire harness is frequently used, such as an electric vehicle or a hybrid vehicle. The conductor core wire 11 may be made of another material (for example, copper or a copper alloy).

The terminal 20 includes a box portion 31 into which a mating terminal (not shown) is to be inserted on the front end side, a first barrel portion 41 to be crimped to the conductor core wire 11 exposed from an end portion of the electric wire 10 on the base end side of the box portion 31, and a second barrel portion 42 to be crimped to the covering body 12 at the end portion of the electric wire on the base end side of the first barrel portion 41. The box portion 31 and the first barrel portion 41 are connected to each other by a first connecting portion 35, and the first barrel portion 41 and the second barrel portion 42 are connected to each other by a second connecting portion 36. A bottom wall and a pair of side walls continuously extending from a base end portion of the box portion 31 to the base end side constitute bottom walls and pairs of side walls respectively belonging to the first connecting portion 35, the first barrel portion 41, the second connecting portion 36, and the second barrel portion 42.

The terminal 20 is formed by performing press working (punching and bending) or the like on a metal plate (plate-shaped body). In the present embodiment, the terminal 20 is formed of a metal material different from that of the conductor core wire 11 made of aluminum or an aluminum alloy. Specifically, the terminal 20 is formed using a metal plate (plate-shaped body) made of copper, a copper alloy, or the like as a base material. The conductor core wire 11 and the terminal 20 do not necessarily have to be made of different types of metal materials, and may be made of the same type of metal material.

For the purpose of, for example, reducing corrosion of the conductor core wire 11 of the electric wire 10 to improve corrosion resistance, it is preferable that the terminal 20 is subjected to a plating treatment after the press working described above and before crimping to the electric wire 10. In the present embodiment, the plating treatment is performed with tin (Sn) on the terminal 20 before crimping to the electric wire 10. Specifically, the terminal 20 is provided with a plating layer containing tin so as to cover a side face including front and back surfaces and a cut surface formed by the press working. A surface of the terminal 20 may be subjected to the plating treatment with another material (for example, gold (Au), silver (Ag), nickel (Ni), or an alloy thereof).

As shown in FIGS. 1A to 3, the box portion 31 has a rectangular tubular shape extending in a front-rear direction and penetrating in the front-rear direction. The box portion 31 is integrally provided with a spring portion 32. The spring portion 32 is a cantilevered leaf spring that extends from a front end portion of the bottom wall of the box portion 31 and extends inside the box portion 31 toward the base end side. The spring portion 32 is elastically deformable in the upper-lower direction. The spring portion 32 extends to a predetermined position on the front end side of the base end portion of the box portion 31. Therefore, a free end (extending end) 32*a* (see FIGS. 2 and 3A) of the spring portion 32 is located inside the box portion 31.

The spring portion 32 is provided with a contact point 32*b* that comes into contact with the mating terminal at a portion in the vicinity of a fixed end (the front end portion of the box portion 31) of the spring portion 32. The contact point 32*b* is a portion that protrudes toward the upper side and extends in the width direction. When a mating terminal (not shown) is inserted from an opening on the front end side of the box portion 31, the mating terminal presses down the contact point 32*b* of the spring portion 32, so that the spring portion 32 is elastically deformed toward the lower side, and the mating terminal is accommodated in the box portion 31. As a result, a state in which the contact point 32*b* and the mating terminal are in press contact with each other is maintained, and the contact point 32*b* (therefore, the terminal 20) and the mating terminal are electrically connected to each other.

A protruding portion 33 protruding toward the upper side is provided on a side wall on one side in the width direction of the base end portion of the box portion 31. The protruding portion 33 is formed by folding a first intermediate portion in the extending direction of a strip-shaped extending piece extending toward the upper side from the side wall into the box portion 31 toward the lower side, and further folding a second intermediate portion closer to an extending end side than the first intermediate portion into the box portion 31 toward the other side in the width direction. The protruding portion 33 functions as a so-called stabilizer that restricts a posture of the terminal 20 when the terminal 20 is accommodated in a housing or the like.

An extending end portion of the protruding portion 33 extending from the second intermediate portion toward the other side in the width direction in the box portion 31 functions as a pressing piece 34. The pressing piece 34 presses the free end 32*a* (or a portion in the vicinity of the free end 32*a*) of the spring portion 32 to the lower side. As a result, the pressing piece 34 presses the free end 32*a* (or the portion in the vicinity of the free end 32*a*) of the spring portion 32 downward at a predetermined position inside the box portion 31 and lower than the contact point 32*b* (see FIGS. 3A and 3B). The operation and effect of this will be described later.

As shown in FIG. 2, a pair of crimping pieces 45 extending toward the upper side before crimping to the electric wire 10 are formed on the pair of side walls belonging to the first barrel portion 41. The pair of crimping pieces 45 are provided at the same position in the axial direction of the terminal 20.

As shown in FIG. 2, crimping pieces 46 and 47 extending toward the upper side before crimping to the electric wire 10 are formed on the pair of side walls belonging to the second barrel portion 42. The crimping pieces 46 and 47 are provided at positions not overlapping with each other in the axial direction of the terminal 20.

As shown in FIG. 2, the pair of crimping pieces 45 and the crimping pieces 46 and 47 are crimped using a predetermined crimping machine in a state where the electric wire 10 is disposed in the first barrel portion 41 and the second barrel portion 42 of the terminal 20 before crimping to the electric wire 10 such that the conductor core wire 11 exposed from the end portion of the electric wire 10 is located at a position sandwiched between the pair of crimping pieces 45 and the covering body 12 at the end portion of the electric wire 10 is located at a position sandwiched between the crimping pieces 46 and 47.

As a result, as shown in FIGS. 1A, 1B and 3A, the pair of crimping pieces 45 of the first barrel portion 41 are crimped such that an extending end portion of one crimping piece 45 and an extending end portion of the other crimping piece 45 abut against each other, and are crimped to the conductor core wire 11 exposed from the end portion of the electric wire 10. The crimping pieces 46 and 47 of the second barrel portion 42 are crimped such that the extending end portions of the crimping pieces 46 and 47 overlap each other in the extending direction at different positions in the axial direction of the terminal 20, and are crimped to the covering body 12 at the end portion of the electric wire 10. As described above, the electric wire with terminal 1 shown in FIGS. 1A, 1B and 3A is obtained.

Figure 4A:
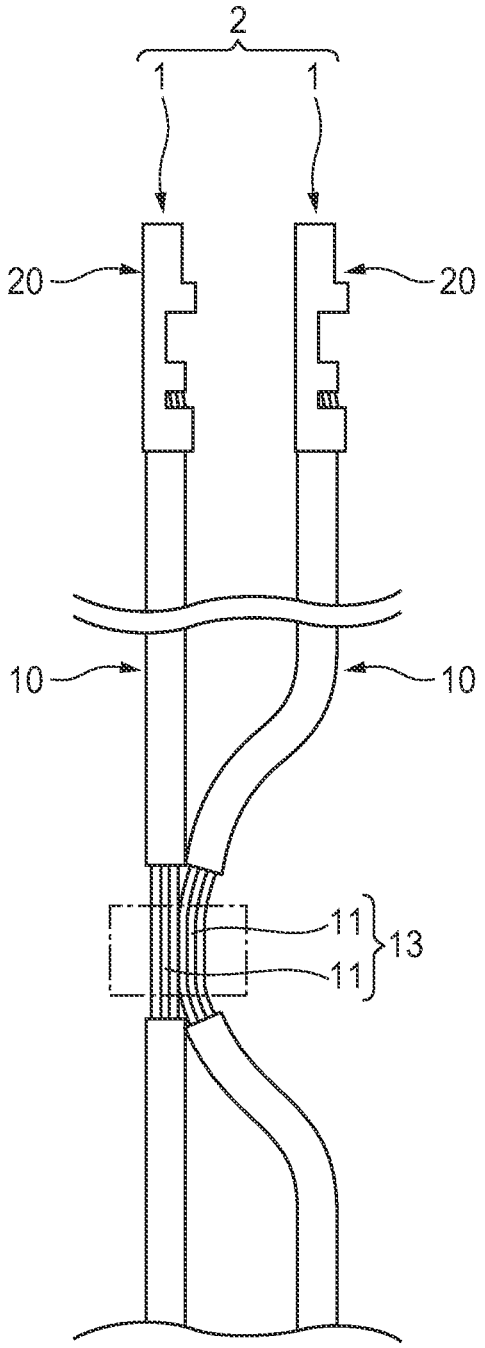
Figure 4B:
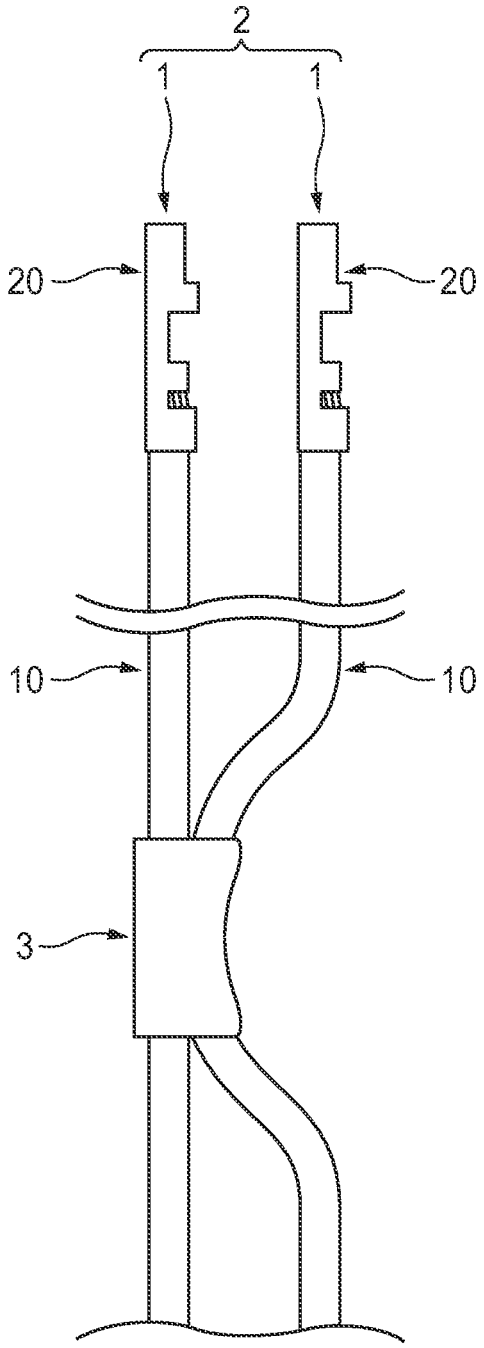

The electric wire with terminal 1 shown in FIGS. 1A, 1B and 3A constitutes, for example, the wire harness 2 shown in FIGS. 4A and 4B. As shown in FIG. 4A, the wire harness 2 includes a bonded portion 13 at which the exposed conductor core wires 11 of the electric wires 10 of the plurality of (two in the present embodiment) electric wires with terminal 1 are ultrasonically bonded to each other. The wire harness 2 may include a bonded portion 13 at which the exposed conductor core wires 11 of three or more electric wires 10 are ultrasonically bonded to each other. In addition, the terminal 20 may not be attached to a part of the plurality of electric wires 10 constituting the wire harness 2. Hereinafter, a bonding machine 50 used for forming the bonded portion 13 will be described.

Figure 5:
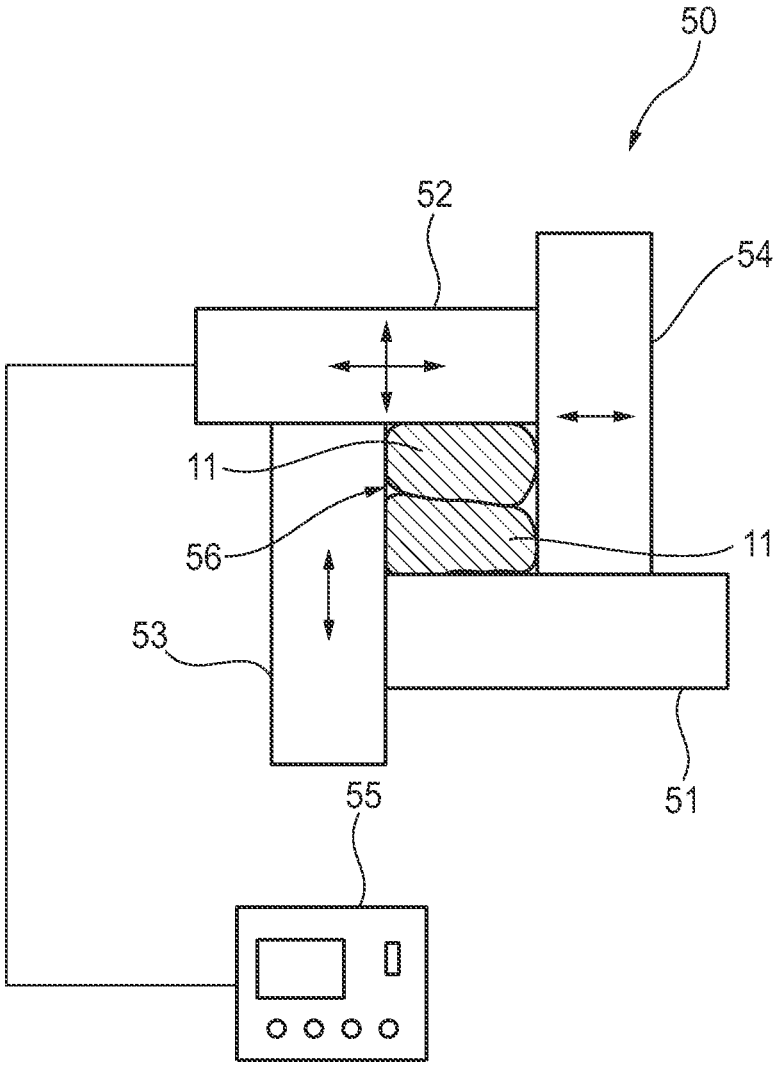
FIG. 5 is a schematic view of an ultrasonic bonding machine for forming the bonded portion of the wire harness shown in FIGS. 4A and 4B.

As shown in FIG. 5, the bonding machine 50 includes a pair of bonding indenters 51 and 52 (so-called an anvil and a horn) facing each other in the upper-lower direction, a pair of flat plate-shaped positioning blocks 53 and 54 facing each other in a left-right direction, and a control device 55 that controls bonding energy (ultrasonic excitation) applied between the pair of bonding indenters 51 and 52.

A prismatic bonding space 56 is defined by the pair of bonding indenters 51 and 52 and the pair of positioning blocks 53 and 54. The exposed conductor core wires 11 of the plurality of electric wires 10 are disposed inside the bonding space 56.

The bonding indenter 51 is fixed to the bonding machine 50. The bonding indenter 52, the positioning block 53, and the positioning block 54 are movable in parallel in directions of the arrows shown in FIG. 5 with respect to the bonding indenter 51. Therefore, the bonding machine 50 can perform ultrasonic welding processing on the plurality of conductor core wires 11 by applying energy (ultrasonic excitation) between the pair of bonding indenters 51 and 52 in a state where the plurality of conductor core wires 11 disposed in the bonding space 56 are compressed. As a result, the bonded portion 13 (see FIG. 4A) at which the plurality of conductor core wires 11 are bonded is formed.

Figure 6A:
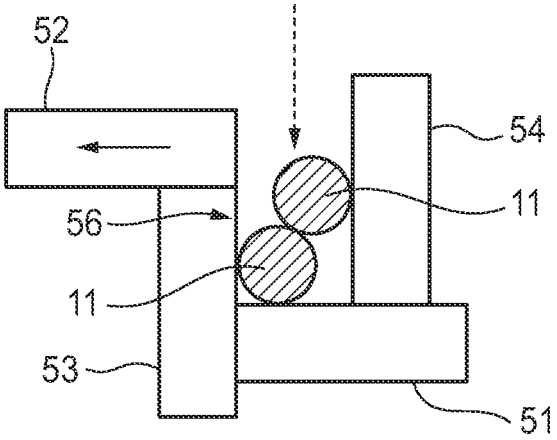
FIGS. 6A to 6C are diagrams for illustrating a procedure for performing a bonding processing by the ultrasonic bonding machine shown in FIG. 5.

Specifically, first, as shown in FIG. 6A, in the bonding machine 50, the bonding indenter 52 is moved to the left (in a direction away from the positioning block 54), so that the exposed conductor core wires 11 of the plurality of electric wires 10 are disposed in the bonding space 56 from the upper side in a state where the upper side of the bonding space 56 is opened.

Figure 6B:
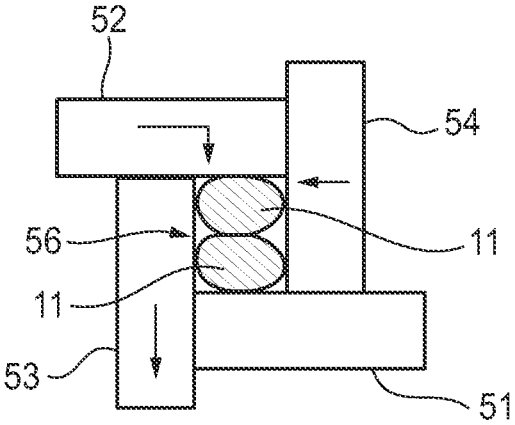

Next, as shown in FIG. 6B, the bonding indenter 52 is moved to the right (in a direction approaching the positioning block 54) to close the upper side of the bonding space 56, and the bonding indenter 52, the positioning block 53, and the positioning block 54 are individually moved in the directions of the arrows shown in FIG. 6B to narrow the bonding space 56, so that a positional relationship of the conductor core wires 11 of the plurality of electric wires 10 is adjusted to a desired manner.

Figure 6C:
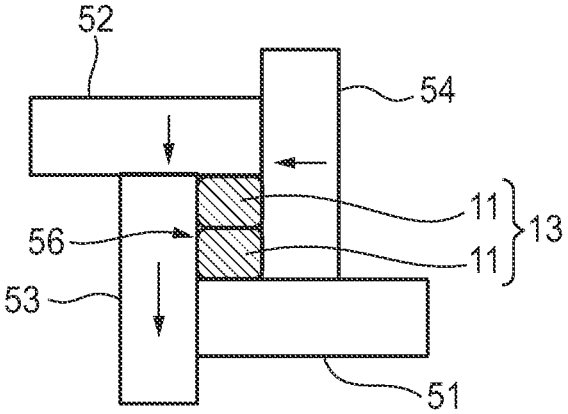

Next, as shown in FIG. 6C, the bonding indenter 52, the positioning block 53, and the positioning block 54 are individually moved in the directions of the arrows shown in FIG. 6C to further narrow the bonding space 56, so that the conductor core wires 11 of the plurality of electric wires 10 are compressed, and energy (ultrasonic excitation) of a predetermined magnitude is applied between the pair of bonding indenters 51 and 52 in a state where the plurality of conductor core wires 11 are compressed. As a result, the ultrasonic bonding processing is performed on the plurality of conductor core wires 11 to form the bonded portion 13 (see FIG. 4A) at which the plurality of conductor core wires 11 are bonded.

In the ultrasonic bonding processing described above, the spring portion 32 of the terminal 20 attached to the electric wire 10 may vibrate (typically, vertically) due to vibration or the like applied to the electric wire 10, and deterioration, deformation, or the like of the spring portion 32 may occur. From the viewpoint of improving the reliability of the electrical connection between the terminal 20 and the mating terminal, it is desirable to reduce such deterioration or the like of the spring portion 32 as much as possible.

In this regard, in the terminal 20, as described above, the free end 32*a* (or the portion in the vicinity of the free end 32*a*) of the spring portion 32 provided in the box portion 31 is pressed downward by the pressing piece 34 at the predetermined position inside the box portion 31 and lower than the contact point 32*b*. As a result, even when an external force such as vibration is applied to the terminal 20, since a vibration range of the spring portion 32 is limited by the pressing piece 34 (that is, the spring portion 32 is not deformed to a range exceeding a pressed position), deterioration or the like of the spring portion 32 due to such vibration or the like can be reduced. In particular, according to experiments and consideration of the inventor, it is found that deterioration and the like of the spring portion 32 can be particularly effectively reduced as long as the displacement of the free end 32*a* of the spring portion 32 remains within a range in which the free end 32*a* does not exceed the contact point 32*b* of the spring portion 32 (that is, does not exceed the pressed position). Further, since the pressing piece 34 presses the spring portion 32 inside the box portion 31, the shape of the entire terminal 20 can be reduced in size as compared with a case where the pressing piece 34 presses the spring portion 32 outside the box portion 31 in the same manner.

In the present embodiment, the two conductor core wires 11 shown in FIG. 4A are made of the same kind of metal material (in this example, aluminum or an aluminum alloy). However, each of the plurality of conductor core wires 11 may be made of different types of metal materials (for example, copper or a copper alloy, and aluminum or an aluminum alloy). By the ultrasonic bonding processing, even the conductor core wires 11 made of different types of metal materials can be appropriately electrically connected.

A bonding mark by the ultrasonic bonding is formed on an outer surface of the bonded portion 13. In the present embodiment, the bonding mark has a shape in which the unevenness of the surfaces of the bonding indenters 51 and 52 used for the ultrasonic bonding is transferred, and can be identified from the outer surface of the bonded portion 13.

As shown in FIG. 4B, a protective member 3 that covers the entire outer surface of the bonded portion 13 is preferably mounted to the bonded portion 13 shown in FIG. 4A. As a result, it is possible to prevent the bonded portion 13 from being damaged due to collision of the bonded portion 13 with surrounding members, and to prevent occurrence of an unintended short circuit due to contact of the bonded portion 13 with surrounding conductive members.

As described above, according to the terminal 20 of the present embodiment, a bending range of the spring portion 32 is restricted at the predetermined position (pressed position) described above such that a portion between the contact point 32*b* and the free end 32*a* of the spring portion 32 provided in the box portion 31 is located on a bending direction side (lower side) with respect to the predetermined position. As a result, when an external force such as vibration is applied to the terminal 20, the vibration of the spring portion 32 is reduced as compared with a case where the pressing piece 34 is not provided. Further, since the pressing piece 34 presses the spring portion 32 inside the box portion 31, the shape of the entire terminal 20 can be reduced in size as compared with a case where the bending range is restricted outside the box portion 31 in the same manner. Therefore, the terminal 20 according to the present embodiment has excellent durability against vibration or the like applied from the outside.

Further, according to the terminal 20 of the present embodiment, the free end 32*a* of the spring portion 32 is pressed by the pressing piece 34. By restricting the bending range of the free end 32*a* of the terminal 20 whose amplitude can be particularly increased by vibration or the like, the durability of the terminal 20 against vibration or the like applied from the outside can be further improved.

Further, according to the terminal 20 of the present embodiment, the pressing piece 34 is provided on the extending end of the protruding portion 33 (a so-called stabilizer for regulating the posture when the terminal 20 is accommodated in the housing or the like) provided in the box portion 31 of the terminal 20. As a result, the structure of the terminal 20 can be rationalized and the overall shape of the terminal 20 can be further reduced in size, as compared with a case where the protruding portion 33 and the pressing piece 34 are provided as separate independent members.

Further, according to the wire harness 2 of the present embodiment, when the conductor core wires 11 of the plurality of electric wires 10 are ultrasonically bonded to each other, even if an external force such as vibration is applied to the terminal 20, the vibration of the spring portion 32 is reduced by the pressing piece. Therefore, the wire harness 2 according to the present embodiment can improve the reliability of the electrical connection between the terminal 20 attached to the electric wire 10 and the mating terminal.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

Figure 3B:
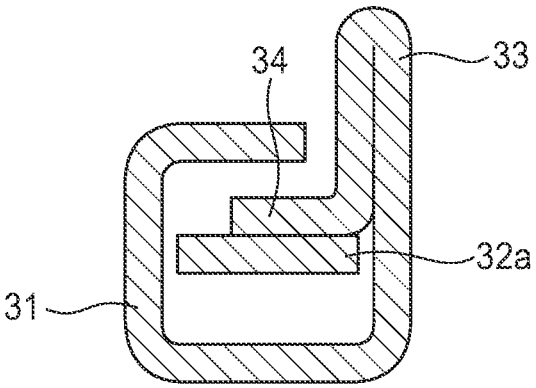
FIG. 3B is a cross-sectional view taken along a line B-B in FIG. 1B.
Figure 7A:
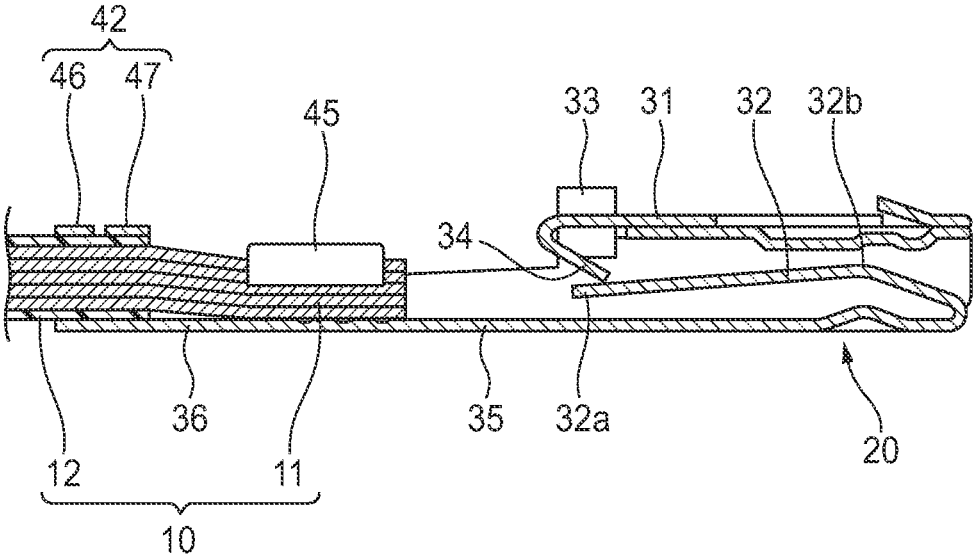
FIGS. 7A and 7B are views according to a first modification, which correspond to FIG. 3A and FIG. 3B, respectively.
Figure 7B:
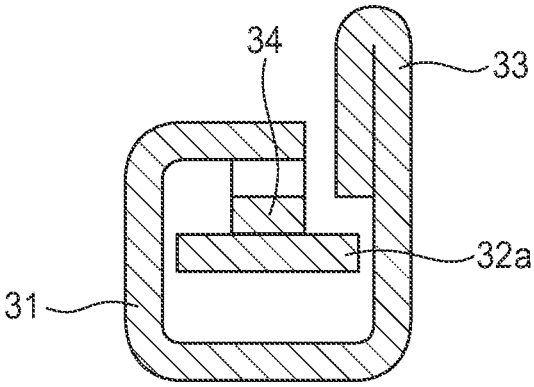

In the embodiment shown in FIGS. 1A to 6, the pressing piece 34 has a shape obtained by extending in a beam shape from the protruding portion 33 of the terminal 20 and bending toward the spring portion 32 (see FIGS. 3A and 3B). On the other hand, as shown in FIGS. 7A and 7B, the pressing piece 34 may have a shape extending obliquely toward the front end side and the lower side from the base end portion of an upper wall of the box portion 31 of the terminal 20 toward (the free end 32*a* of) the spring portion 32. This also allows the pressing piece 34 to press the free end 32*a* (or a portion in the vicinity of the free end 32*a*) of the spring portion 32 downward at a predetermined position inside the box portion 31 and lower than the contact point 32*b*.

Figure 8A:
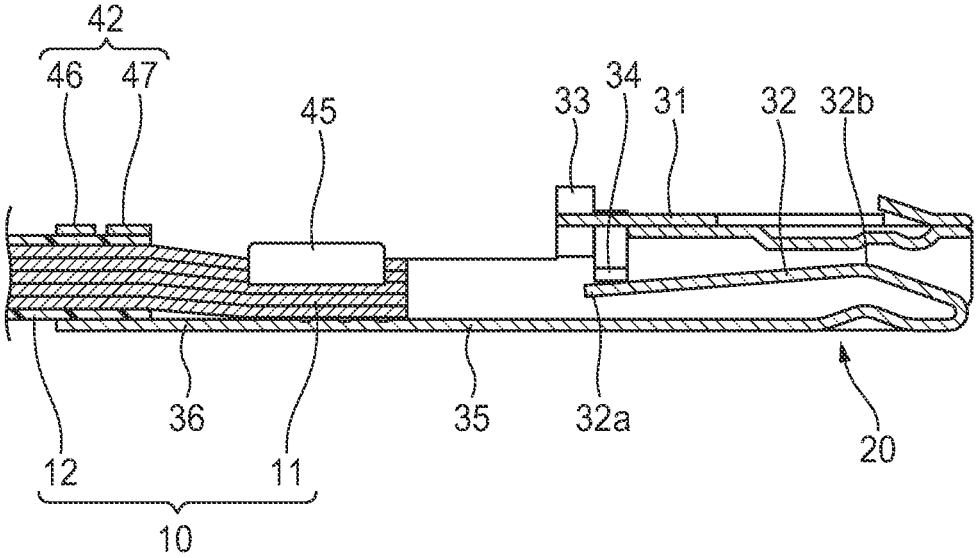
FIGS. 8A and 8B are views according to a second modification, which correspond to FIG. 3A and FIG. 3B, respectively.
Figure 8B:
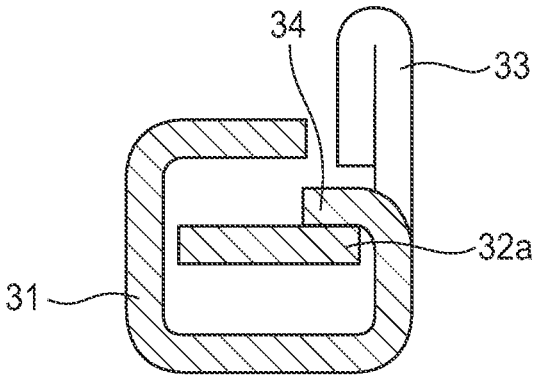

Further, as shown in FIGS. 8A and 8B, the pressing piece 34 may have a shape cut and raised inward in the width direction from one side wall of the box portion 31 of the terminal 20 toward the spring portion 32. This also allows the pressing piece 34 to press the free end 32*a* (or a portion in the vicinity of the free end 32*a*) of the spring portion 32 downward at a predetermined position inside the box portion 31 and lower than the contact point 32*b*.

Figure 9:
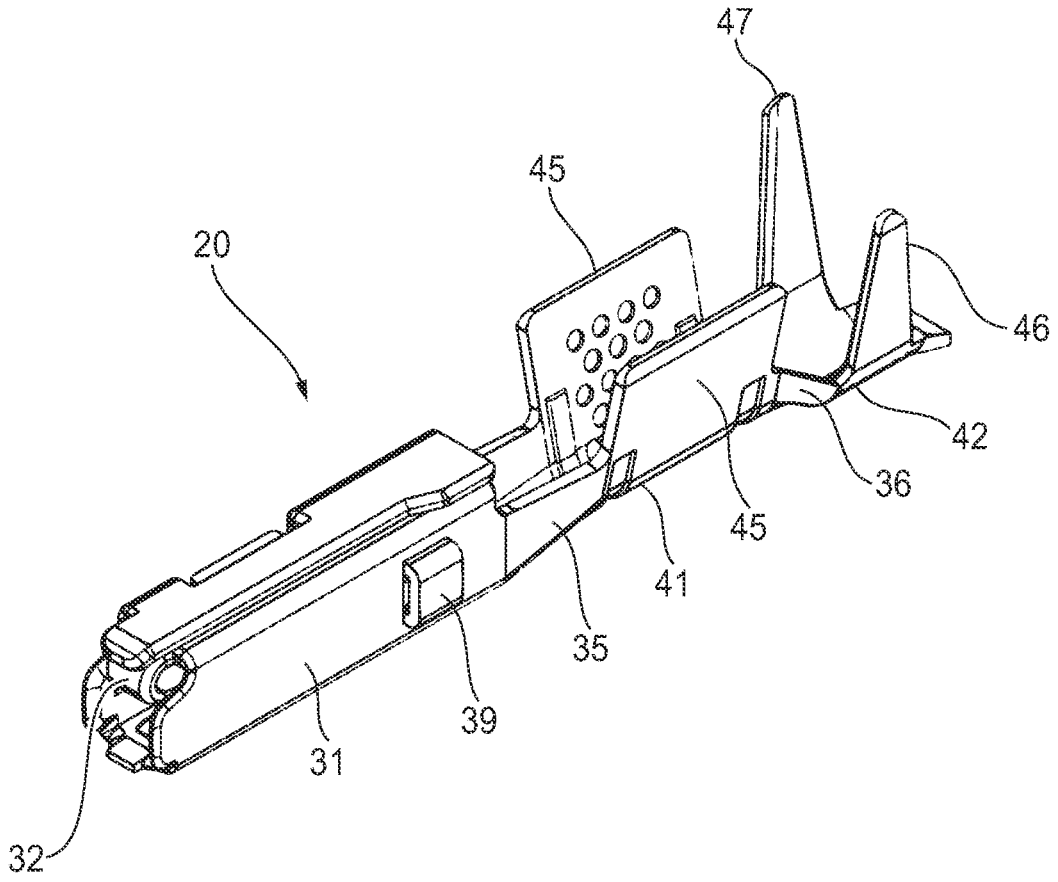
FIG. 9 is a perspective view showing a terminal according to a third modification (corresponding to FIG. 2)

Further, in the embodiment shown in FIGS. 1A to 8, the spring portion 32 has a cantilever shape extending from the front end portion of the bottom wall of the box portion 31 (for example, see FIGS. 1A, 1B and 3). On the other hand, as shown in FIGS. 9, 10A and 10B, the spring portion 32 may have a cantilever shape extending from a front end portion of the upper wall of the box portion 31.

Figure 10A:
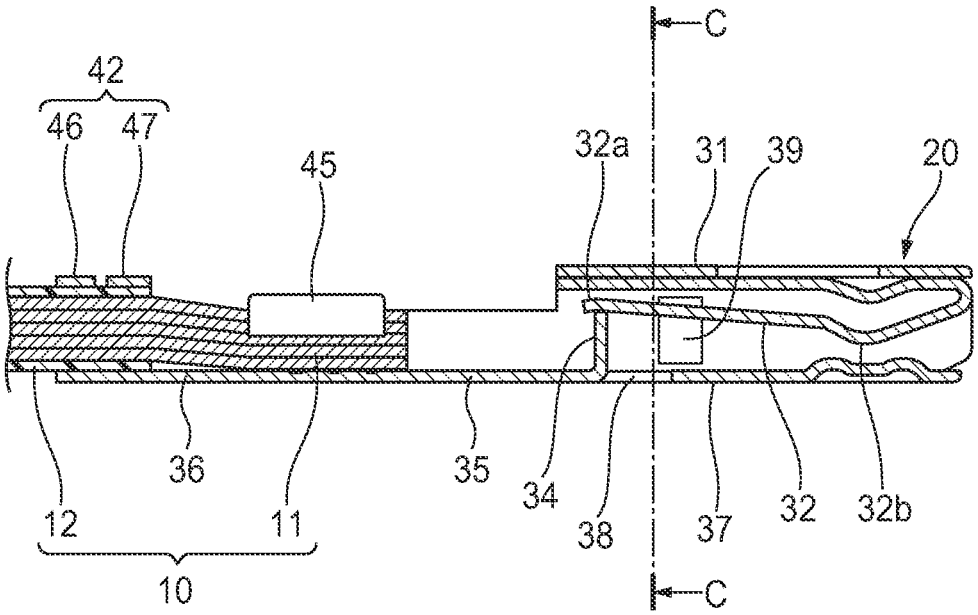
FIG. 10A is a view according to the third modification, which corresponds to a terminal portion of FIG. 3A.

More specifically, as shown in FIG. 10A, the spring portion 32 extends from the front end portion of the upper wall of the box portion 31, extends inside the box portion 31 toward the base end side, and reaches a predetermined position on the front end side of the base end portion of the box portion 31. Also in this example, the free end (extending end) 32*a* of the spring portion 32 is located inside the box portion 31. The spring portion 32 is elastically deformable in the upper-lower direction. A contact point 32*b* that comes into contact with the mating terminal at a portion in the vicinity of the fixed end (the front end portion of the box portion 31) of the spring portion 32 is provided. The contact point 32*b* is a portion that protrudes toward the lower side and extends in the width direction. When a mating terminal (not shown) is inserted from an opening on the front end side of the box portion 31, the mating terminal presses up the contact point 32*b* of the spring portion 32, so that the spring portion 32 is elastically deformed toward the upper side, and the mating terminal is accommodated in the box portion 31. As a result, a state in which the contact point 32*b* and the mating terminal are in press contact with each other is maintained, and the contact point 32*b* (therefore, the terminal 20) and the mating terminal are electrically connected to each other.

Figure 10B:
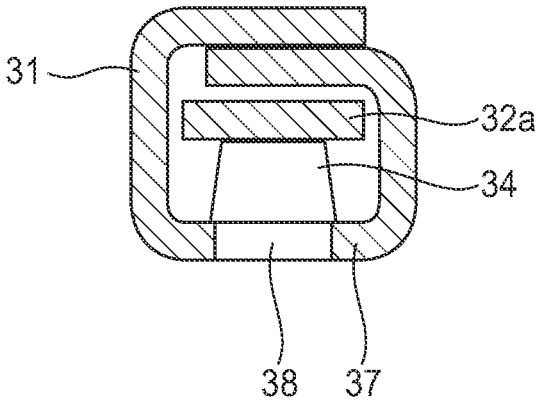
FIG. 10B is a cross-sectional view taken along a line C-C in FIG. 10A.

As shown in FIGS. 10A and 10B, in this example, the pressing piece 34 has a shape cut and raised upward from the bottom wall 37 of the box portion 31 of the terminal 20 toward the spring portion 32. The pressing piece 34 has a shape (a so-called tapered shape) in which a width gradually decreases toward the upper side. The bottom wall 37 of the box portion 31 has an opening portion 38 having a shape corresponding to the cut and raised pressing piece 34. The pressing piece 34 presses the free end 32*a* (or a portion in the vicinity of the free end 32*a*) of the spring portion 32 to the upper side. As a result, the pressing piece 34 presses the free end 32*a* (or the portion in the vicinity of the free end 32*a*) of the spring portion 32 upward at a predetermined position inside the box portion 31 and upper than the contact point 32*b* (see FIGS. 3A and 3B).

In the terminal 20 of the present example, the free end 32*a* (or the portion in the vicinity of the free end 32*a*) of the spring portion 32 is pressed upward at the above-described predetermined position by the pressing piece 34. As a result, as in the embodiment shown in FIGS. 1A to 8, even when an external force such as vibration is applied to the terminal 20, since a vibration range of the spring portion 32 is limited by the pressing piece 34 (that is, the spring portion 32 is not deformed to a range exceeding a pressed position), deterioration or the like of the spring portion 32 due to such vibration or the like can be reduced. Further, since the displacement of the free end 32*a* of the spring portion 32 remains within a range in which the free end 32*a* does not exceed the contact point 32*b* of the spring portion 32 (that is, does not exceed the pressed position), it is possible to particularly effectively reduce deterioration or the like of the spring portion 32. Further, since the pressing piece 34 presses the spring portion 32 inside the box portion 31, the shape of the entire terminal 20 can be reduced in size.

As shown in FIG. 9, a protruding portion 39 protruding outward in the width direction is provided on a side wall on one side in the width direction of the base end portion of the box portion 31. Similar to the protruding portion 33 in the embodiment shown in FIGS. 1A to 8B, the protruding portion 39 functions as a so-called stabilizer that restricts a posture of the terminal 20 when the terminal 20 is accommodated in a housing or the like. As can be understood from the above description, the spring portion 32 may have a cantilever shape extending from the front end portion of the side wall of the box portion 31, instead of the bottom wall 37 or the upper wall of the box portion 31.

Further, in the embodiment shown in FIGS. 1A to 8B, the pressing piece 34 presses the free end 32*a* (or a portion in the vicinity of the free end 32*a*) of the spring portion 32 downward at a predetermined position inside the box portion 31 and lower than the contact point 32*b*. On the other hand, the pressing piece 34 may press a portion between the free end 32*a* and the contact point 32*b* of the spring portion 32 sufficiently away from the free end 32*a* downward at a predetermined position inside the box portion 31 and lower than the contact point 32*b*.

On the other hand, in the embodiment shown in FIGS. 9, 10A and 10B, the pressing piece 34 presses the free end 32*a* (or a portion in the vicinity of the free end 32*a*) of the spring portion 32 upward at a predetermined position inside the box portion 31 and upper than the contact point 32*b*. On the other hand, the pressing piece 34 may press a portion between the free end 32*a* and the contact point 32*b* of the spring portion 32 sufficiently away from the free end 32*a* upward at a predetermined position inside the box portion 31 and upper than the contact point 32*b*.

Further, in each of the embodiments shown in FIGS. 1A to 10B, for convenience of explanation, the pressing piece 34 is described so as to be always in contact with the spring portion 32. However, it is sufficient that the pressing piece 34 can restrict the bending range of the spring portion as described above, and the pressing piece 34 is not necessarily in contact with the spring portion 32 at all times at the predetermined position (pressed position), and for example, a part of the pressing piece 34 (for example, a front end portion of the pressing piece 34) may be present at the pressed position.

Further, in the embodiments shown in FIGS. 1A to 10B, the pair of crimping pieces 45 of the terminal 20 are crimped to the conductor core wire 11 of the electric wire 10, so that the terminal 20 and the conductor core wire 11 are electrically connected to each other. However, for example, the terminal 20 and the conductor core wire 11 may be electrically connected to each other by bonding the conductor core wire 11 of the electric wire 10 to the terminal 20 by ultrasonic bonding processing instead of or in addition to the crimping. Even when the terminal 20 and the conductor core wire 11 are ultrasonically bonded to each other as described above, the bending range of the spring portion 32 is restricted by the pressing piece 34 in the same manner as described above, so that the reliability of the electrical connection between the terminal 20 and the mating terminal can be improved. Also in this case, the conductor core wire 11 and the terminal 20 may be made of different types of metal materials or may be made of the same type of metal material.

According to the above exemplary embodiments, a terminal (20) to be attached to an electric wire (10), the terminal (20) comprising:

a tubular box portion (31) to receive a mating terminal;

a spring portion (32) extending in a beam shape from a front end portion of the box portion (31), a free end (32*a*) of the spring portion (32) being inside the box portion (31) with respect to a rear end portion of the box portion (31), and the spring portion (32) having a contact point (32*b*) with the mating terminal; and a pressing piece (34) configured to restrict a bending range of the spring portion (32), the spring portion (32) being configured to elastically deform in a bending direction away from the mating terminal upon the mating terminal coming into contact with the contact point (32*b*), and the pressing piece (34) being placed at a pressing position located inside the box portion (31) and away from the contact point (32*b*) in the bending direction, the pressing piece being configured to restrict the bending range of the spring portion (32) to achieve at least part of the spring portion (32) closer to the free end (32*a*) than the contact point (32*b*) being located on the bending direction side with respect to the pressing position.

According to the terminal having the above configuration, the bending range of the spring portion is restricted at the pressing position located inside the box portion and on the bending direction side than the contact point so that a portion closer to the free end than the contact point of the spring portion provided in the box portion is located on the bending direction side with respect to the pressing position. As a result, even when an external force such as vibration is applied to the terminal, since a vibration range of the spring portion is limited by the pressing piece (that is, the spring portion is not deformed to a range exceeding a pressing position), deterioration or the like of the spring portion due to such vibration or the like can be reduced. In particular, according to experiments and consideration of the inventor, it is found that deterioration and the like of the spring portion can be particularly effectively reduced as long as the displacement of the free end of the spring portion remains within a range in which the free end does not exceed the contact point of the spring portion (that is, does not exceed the pressing position). Further, since the pressing piece restricts the bending range of the spring portion inside the box portion, the shape of the entire terminal can be reduced in size as compared with a case where the bending range of the spring portion is restricted outside the box portion. As described above, the terminal having this configuration is excellent in durability against vibration or the like applied from the outside.

The specific shape and the like of the "pressing piece" are not particularly limited. For example, the pressing piece may have a shape that extends in a beam shape from a part of the terminal (for example, a side wall of the box portion) and is bent toward the spring portion, may have a shape that is cut and raised from a part of the terminal (for example, a side wall of the box portion) toward the spring portion, or may have a shape that extends from the box portion toward the spring portion. It is sufficient that the "pressing piece" can restrict the bending range of the spring portion as described above, and the pressing piece is not necessarily in contact with the spring portion at all times at the pressing position, and for example, a part of the pressing piece (for example, a front end portion of the pressing piece) may be present at the pressing position.

Further, a method of attaching the "terminal" to the electric wire is not particularly limited. For example, the terminal may be crimped to the conductor core wire of the electric wire, may be welded to the conductor core wire by a laser or the like, or may be bonded to the conductor core wire by ultrasonic bonding processing.

Since the terminal having the above configuration is excellent in durability against vibration or the like, even if the plurality of electric wires to which the terminal is attached are bonded by the ultrasonic bonding processing as described above, deterioration or the like of the terminal (particularly, the spring portion) can be reduced. Similarly, even in a case where the ultrasonic bonding processing is used to attach the terminal to the electric wire, the above-described effect of reducing the vibration of the spring portion is exerted, and thus it is possible to reduce deterioration or the like of the terminal (particularly, the spring portion).

In the terminal (20), the pressing piece (34) may be configured to restrict a bending range of the spring portion (32) to achieve the free end (32*a*) of the spring portion (32) is positioned on the bending direction side with respect to the pressing position.

According to the terminal having the above configuration, the pressing piece restricts the bending range of the free end of the terminal whose amplitude can be particularly increased by vibration or the like, and thus it is possible to further improve the durability of the terminal against vibration or the like.

The terminal (20) may further comprises:

a protruding portion (33) extending from a side wall of the box portion (31) toward outside of the box portion (31) and being folded back its extending end toward inside of the box portion (31), the pressing piece (34) may be provided on the extending end of the protruding portion (33).

According to the terminal having the above configuration, the pressing piece is provided on the extending end of the protruding portion (for example, a so-called stabilizer for regulating the posture when the terminal is accommodated in a housing or the like) provided in the box portion of the terminal. Accordingly, for example, as compared with a case where the pressing piece and the protruding portion are provided as separate independent members, it is possible to rationalize the structure of the terminal and implement miniaturization of the terminal and the like.

According to the above exemplary embodiments, a wire harness (2) comprising:

a plurality of electric wires (10); and the above described terminal (20) attached to at least one of the plurality of electric wires (10), the wire harness having a bonded portion (13), conductor core wires (11) of the plurality of electric wires (10) being bonded with each other to form the bonded portion (13), and the bonded portion (13) having a bonding mark formed by ultrasonic bonding processing.

According to the wire harness having the above configuration, when the conductor core wires of the plurality of electric wires are bonded to each other by the ultrasonic bonding processing, even if an external force such as vibration is applied to the terminal, the vibration of the spring portion is reduced by the pressing piece. Therefore, deterioration or the like of the terminal (particularly, the spring portion) can be reduced. Therefore, the wire harness of the present configuration can improve the reliability of the electrical connection between the terminal attached to the electric wire and the mating terminal.

According to the above exemplary embodiments, an electric wire with terminal comprising:

an electric wire (10); and the above described terminal (20) attached to the electric wire (10), a conductor core wire (11) of the electric wire and the terminal (20) being bonded to each other to form a bonded portion, and the bonded portion having a bonding mark formed by ultrasonic bonding processing.

According to the electric wire with terminal having the above configuration, when the conductor core wire of the electric wire and the terminal are bonded by the ultrasonic bonding processing, even if an external force such as vibration is applied to the terminal, vibration of the spring portion is reduced by the pressing piece. Therefore, deterioration or the like of the terminal (particularly, the spring portion) can be reduced. Therefore, the electric wire with terminal of the present configuration can improve the reliability of the electrical connection between the terminal attached to the electric wire and the mating terminal.

The "bonding mark" typically has a shape in which unevenness of the surface of a bonding indenter (a so-called horn, anvil, or the like) used in the ultrasonic bonding processing is transferred. Therefore, normally, the presence or absence of the bonding mark can be identified by observing the outer surface of the bonded portion. An internal structure that does not appear on the outer surface of the bonded portion, such as a bonded state at the interface between the conductor core wires, may also be the "bonding mark".

As described above, according to the present invention, it is possible to provide a terminal excellent in durability against vibration or the like applied from the outside, a wire harness using an electric wire to which such a terminal is attached, and an electric wire with terminal to which such a terminal is attached.

What is claimed is:

1. A terminal to be attached to an electric wire, the terminal comprising:

a tubular box portion to receive a mating terminal;

a spring portion extending in a beam shape from a front end portion of the box portion, a free end of the spring portion being inside the box portion with respect to a rear end portion of the box portion, and the spring portion having a contact point with the mating terminal; and a pressing piece configured to restrict a bending range of the free end of the spring portion, the spring portion being configured to elastically deform in a bending direction away from the mating terminal upon the mating terminal coming into contact with the contact point, and the pressing piece being placed at a pressing position located inside the box portion and away from the contact point in the bending direction, the pressing piece being configured to, in the bending direction, only partly restrict the bending range of the free end of the spring portion to achieve at least part of the spring portion closer to the free end than the contact point being located on the bending direction side with respect to the pressing position.

2. The terminal according to claim 1, wherein the pressing piece is configured to restrict a bending range of the spring portion to achieve the free end of the spring portion is positioned on the bending direction side with respect to the pressing position.

3. The terminal according to claim 1, further comprising:

a protruding portion extending from a side wall of the box portion toward outside of the box portion and being folded back its extending end toward inside of the box portion, the pressing piece is provided on the extending end of the protruding portion.

4. A wire harness comprising:

a plurality of electric wires; and the terminal according to claim 1 attached to at least one of the plurality of electric wires, the wire harness having a bonded portion, conductor core wires of the plurality of electric wires being bonded with each other to form the bonded portion, and the bonded portion having a bonding mark formed by ultrasonic bonding processing.

5. An electric wire with terminal comprising:

an electric wire; and the terminal according to claim 1 attached to the electric wire, a conductor core wire of the electric wire and the terminal being bonded to each other to form a bonded portion, and the bonded portion having a bonding mark formed by ultrasonic bonding processing.

6. The terminal according to claim 1, wherein the box portion comprises pairs of inner walls facing ones of each other and collectively surrounding the free end of the spring portion, and wherein the free end of the spring portion is separated from each of the inner walls of the box portion.

7. The terminal according to claim 1, wherein along a longitudinal direction of the terminal, at least a portion of the pressing piece is further away from the contact point than is any portion of the spring portion.

* * * * *